United States Patent [19]

Latchague

[11] 4,221,315

[45] Sep. 9, 1980

[54] APPARATUS FOR REMOVING A DEAD-HEAD FROM A CASTING

[75] Inventor: Guy Latchague, Le Chesnay, France

[73] Assignees: S.A. Automobiles Citroen; Societe Dite Automobiles Peugeot, both of Paris, France

[21] Appl. No.: 922,482

[22] Filed: Jul. 6, 1978

[30] Foreign Application Priority Data

Jul. 7, 1977 [FR] France ..... 77 21840
May 26, 1978 [FR] France ..... 78 16496

[51] Int. Cl.[3] ..... B26F 3/00
[52] U.S. Cl. ..... 225/97; 225/103
[58] Field of Search ..... 225/97, 103, 93

[56] References Cited

U.S. PATENT DOCUMENTS 1,508,358 9/1924 Brown ..... 225/103 X
2,979,095 4/1961 Jovis ..... 225/97 X
3,540,639 11/1970 Carlson ..... 225/97
3,990,825 11/1976 Pasch ..... 225/93
4,110,885 9/1978 Fisher ..... 225/97 X

FOREIGN PATENT DOCUMENTS 555987 4/1977 U.S.S.R. ..... 225/97
570462 8/1977 U.S.S.R. ..... 225/103

*Primary Examiner*—Frank T. Yost
*Attorney, Agent, or Firm*—Karl F. Ross

[57] ABSTRACT

An apparatus for removing a dead-head from a casting comprises a device for exerting on the dead-head or the casting a force which does not pass through the joining neck between the dead-head and the casting. This force generates bending moments which cause the dead-head and casting to break apart at the neck. The force can be applied by a fluid-actuated cylinder which acts on the dead-head or casting either directly or via a linkage comprising one or more levers.

14 Claims, 8 Drawing Figures

APPARATUS FOR REMOVING A DEAD-HEAD FROM A CASTING

BACKGROUND OF THE INVENTION

1. Field of the Invention

The invention relates to an apparatus for breaking a neck joining a casting to a dead-head.

2. Description of the Prior Art

In mass-production casting plants it is usual to cast a number of workpieces in a single mold. When the mold is made, provision is generally made in the vicinity of each casting cavity for one or more auxiliary cavities which are joined to the casting cavity by a part of narrowing cross-section, and from which metal may flow into the casting cavity so as to ensure the complete filling of the latter in spite of the shrinking due to cooling. In this way a group of castings is obtained, each of which is connected, by means of a neck, to one or more dead-heads. It is also possible to obtain a group of castings having a single, common, dead-head. After the removal of the refractory materials, the dead-heads are removed, for example by means of a hammer, and the castings are separated from the group by sectioning or sawing.

Various devices have been proposed for mechanically removing the head-heads from the castings, but these devices can be used only in certain particular cases.

SUMMARY OF THE INVENTION

According to the invention, there is provided an apparatus for breaking a joining neck between a casting and a dead-head of a casting/dead-head unit, comprising means for exerting on one of the two elements formed by the casting and the dead-head, a force directed along a direction which does not pass through the joining neck thereby applying to the said one element a bending moment which will break off the said element at the joining neck.

In one preferred embodiment a pusher is movable along a support axis of the other element, and relative to which there is pivotally mounted, about an axis perpendicular to the support axis, at least one lever whose free end may rest, directly or indirectly, upon the element to be removed. This pusher is advantageously connected to the plunger of a hydraulic cylinder. The lever may be mounted directly on the pusher, but, in the case where the casting has a central dead-head and at least one side dead-head, provision may be made for a pair of levers pivotally mounted on a bridge-type support arranged to be placed astride on the central dead-head and whose free ends are joined together by a cross-piece intended to rest upon the side dead-head.

There may be one or more pairs of pivotal levers, the axes of the various levers being carried by a single movable plate, and a fluid actuated cylinder being provided to move the plate relative to a fixed frame. This construction is suitable, in particular, in the case where the casting from which dead-heads have to be removed has dead-heads distributed symmetrically about a vertical plane, or again when a casting of small size has two symmetrical dead-heads; in this case, a certain number of castings are fixed simultaneously in the apparatus.

When the cylinder is single-acting, locking means are provided to hold the plate in its inoperative position corresponding to the inoperative condition of the cylinder.

The apparatus may also comprise a rotating plate or a linearly-movable chain upon which supports are mounted for the castings whose dead-heads are to be removed, the plate or chain being movable in front of dead-head removal stations which each have a dead-head removing lever connected to the piston rod of a fluid-actuated cylinder. This construction is suitable in particular for breaking dead-heads disposed around a casting in assymetrical manner.

The castings whose dead-heads have to be removed lie on the support without being fixed thereto, and each dead-head removal station comprises a holding member for preventing the casting from rocking under the action of the force which is exerted by the lever.

The apparatus has, preferably, two levers or two pairs of levers, which are disposed symmetrically relative to the axis of the support, the two levers, or the two levers of each pair, being connected together in mortise-and-tenon manner.

The free end of the lever, or in the case of a pair of levers pivotally mounted on a bridge-type support, the cross-piece which connects said levers, has advantageously a concave shape arranged to engage a convex portion of the casting, or of the dead-head. Any sliding is thus prevented during the breaking of the joining neck.

The pusher may be movably mounted in a frame upon which a support piece for the casting is mounted perpendicularly to the axis of support. It is thus possible to set the apparatus according to the shape of the casting from which the dead-head has to be removed.

In another alternative construction, fluid-actuated means is mounted on the casting whose dead-head has to be removed and has two or more pistons each arranged to act upon a dead-head to be broken, either directly, or through an articulated lever.

This construction is also suitable for breaking dead-heads disposed around a casting in assymmetrical manner. The fluid actuated means may be made solid with the casting, which is necessary when the distribution of the dead-heads is not symmetrical and desirable when it is symmetrical because the neck of one dead-head may break before the others.

In each of these embodiments, the position of the dead-head and that of the casting may be reversed, so that the dead-head is placed on a support and the effort is exerted upon the castings.

BRIEF DESCRIPTION OF THE DRAWING

Embodiments of the invention will now be described, by way of example only, with reference to the accompanying diagrammatic drawing, in which.

DESCRIPTION OF THE PREFERRED EMBODIMENTS

Figure 1:
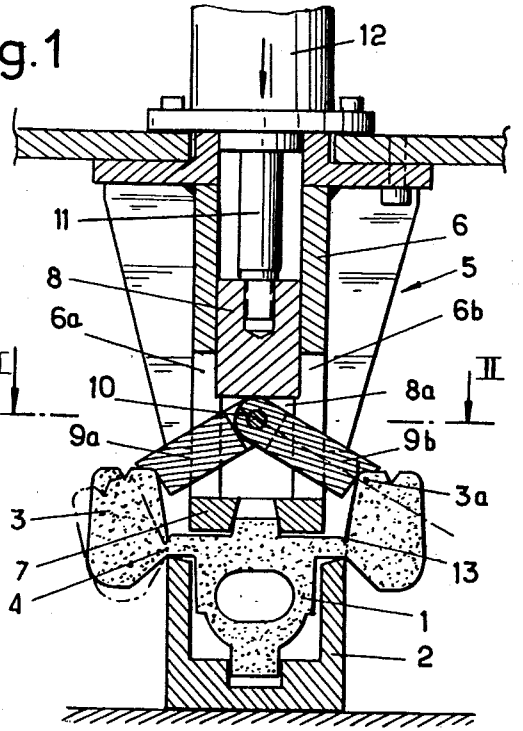
FIG. 1 is a longitudinal section of a first embodiment of the invention.
Figure 2:
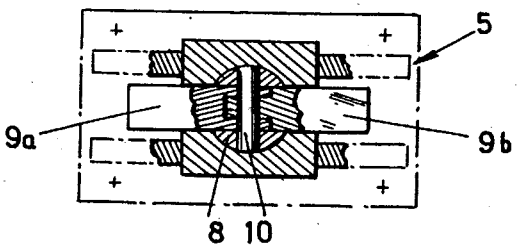
FIG. 2 is a cross-section taken on line II—II of FIG. 1.

There is shown in FIGS. 1 and 2, a machine intended to remove from a casting 1 which is placed on a support 2, dead-heads joined to the casting by a joining neck 4 extending perpendicularly to the axis of the casting and whose plane is parallel with the axis of the casting.

This machine comprises a frame 5 having an internally cylindrical portion 6 which is coaxial with the support 2 and closed at the bottom by a support plate 7 having a shape corresponding to that of the upper face of casting 1. In the cylindrical portion 6 there is slidably mounted a pusher or piston 8 provided with a diametrically extending milled slot 8*a*, at its end facing the plate 7. Two levers 9*a* and 9*b*, which are shaped respectively in mortise-and-tenon fashion at one of their ends, are engaged in the slot 8*a*, and extend through longitudinal apertures 6*a* and 6*b* in the portion 6, the levers 9*a*, 9*b* being pivotally connected to the piston 8 by a pin 10. The free end of each of these levers has a concave shape to engage a convex portion 3*a* of a dead-head. Their length is greater than the minimum distance between the axis of the cylindrical portion 6 and the convex portion 3*a* of the dead-heads in such a manner that, when the free ends of the levers 9*a*, 9*b* are applied on a dead-head 3, they are disposed obliquely relative to the axis of the casting, substantially at 45°, and thus constitute knuckle-joints.

The piston 8 is secured to the end of a piston rod 11 of a fluid-actuated cylinder 12, which is single or double acting, and which is mounted on the upper end of the frame 5.

To use the machine, a casting 1 is located in the support 2 and the machine is then placed on the casting 1 so that the plate 7 rests on the casting and the ends of the levers 9*a* and 9*b* engage the convex portions 3*a* of the dead-heads. The cylinder 12 is then actuated so that the piston 8 is pushed towards the casting 1 thereby moving the levers 9*b* and 9*b* which operate as a knuckle-joint. These levers thus exert upon the dead-heads 3 forces directed along the axis of the levers and substantially perpendicular to the lines 13 marked in FIG. 1; these forces create bending moments on these dead-heads which eventually break at the level of their neck 4.

Figure 3:
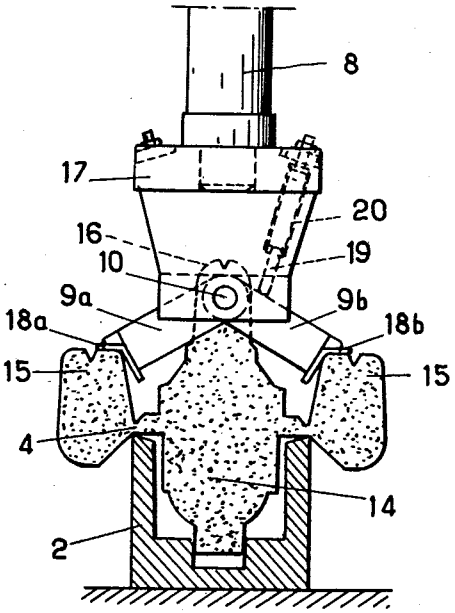
FIG. 3 is an end elevation of a detail of a second embodiment.
Figure 4:
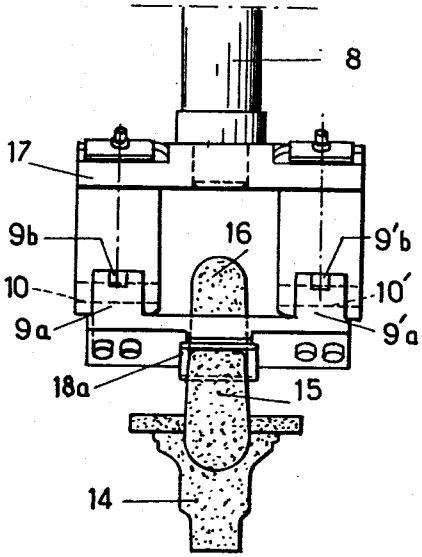
FIG. 4 is a side elevation corresponding to FIG. 3.

The embodiment of FIGS. 3 and 4 is intended to ensure the removal of dead-heads from castings 14 having a central dead-head 16 and side dead-heads 15. In this embodiment the bottom end of the pusher or piston 8 projects in relation to the bottom of the cylindrical portion 6 of the frame 5 and bears a bridge-shaped support 17. Each of two pairs of levers, 9*a*–9*b* and 9'*a*–9'*b* is pivotally connected by a respective pin 10 or 10' to a different one of the ends of the support 17. Two profiled cross-pieces 18*a* and 18*b* of externally concave shape connect the levers 9*a* and 9'*a* and the levers 9*b* and 9'*b* respectively while being directed perpendicularly to said levers.

This machine is used in the same way as that previously described, with reference to FIGS. 1 and 2. The support 8 is placed on the casting 14, astride on the central dead-head 16, the profiled cross-pieces 18*a* and 18*b* being disposed resting against the two lateral dead-heads 15. When the cylinder 12 is actuated, the side dead-heads are each subjected to a bending movement which ensures the breaking of their joining neck 4.

The support 17 may carry pushers which are movable relative to the support, subjected to the action of springs 20 and exerting upon the levers a force which is used to maintain the assembly of levers in a symmetrical position. During the operation of the cylinder, the levers move apart compressing the springs 20.

Figure 6:
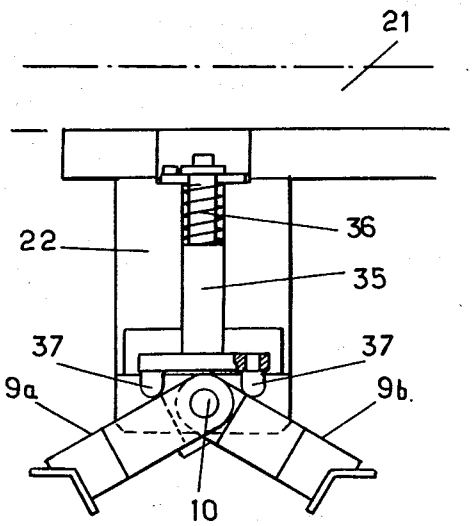
FIG. 6 is an end elevation of a detail of the embodiment of FIG. 5.
Figure 5:
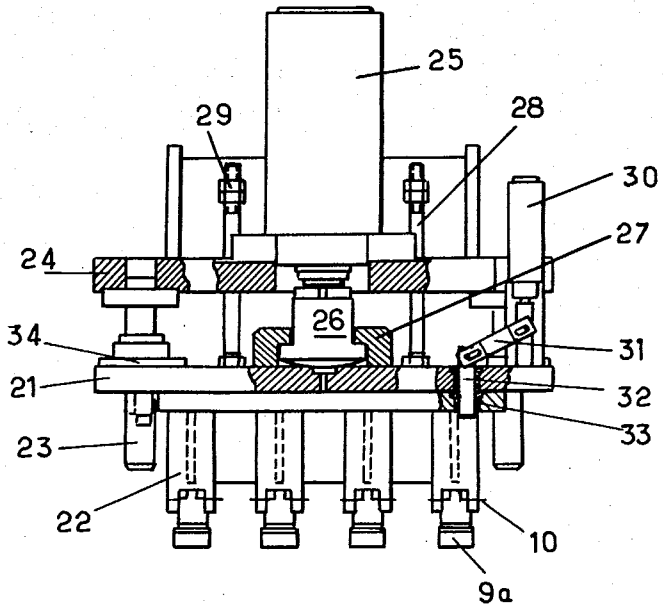
FIG. 5 is a side elevation of a third embodiment.

In the embodiment of FIGS. 5 and 6 provision is made for a movable plate 21 which bears several plates 22 and which is mounted so as to slide on vertical columns 23 carried by a fixed plate 24. Each of the plates 22 bears a pair of dead-head removal levers 9*a*–9*b* which are shaped mortise-and-tenon fashion at one of their ends and are pivotally connected to the plate by a pin 10.

A fluid-actuated cylinder 25 is fixed to the plate 24 and its piston rod carries a cap 26 which is connected to the movable plate 21 by a crown 27. Vertical tie-rods 28 rigid with the plate 21 are slidably mounted in the plate 24 and bear at their free, upper, ends, stop-forming abutments 29.

The plate 24 also carries a locking fluid-actuated cylinder 30, the piston rod of which is connected by a small rod 31 to a rod 32 which passes through the plate 21 and is provided at its end with a positioning leg 33 arranged to hold the plate 21 in an upper position, in contact with fixed abutments 34 on the vertical columns 23.

Each of the plates 22 has, passing through it, a vertical rod 35 which is mounted so as to slide in the plate against the action of a spring 36, and bears, at its end, two pushers 37 which exert on the levers 9*a* and 9*b* a force tending to hold the assembly of these levers in symmetrical positions about the vertical.

In its rest position, the machine is situated as shown in FIGS. 5 and 6. The ends of the levers 9*a* and 9*b* having been engaged on the dead-heads, the cylinder 25 is actuated to move the plate 21 away from the fixed plate 24 and thereby to move the pairs of levers 9*a*–9*b* in a sense to cause the removal of the dead-heads. During this movement the levers 9*a*–9*b* pivot about the pins 10 and push the pushers 37 and the rods 35 against the springs 36.

At the end of the operation, the cylinder 25 is drained, the plate 21 is raised manually and the cylinder 30 is actuated so as to lock plate 21 in its top position. As the plate 21 is raised, the pushers 37 move, under the action of the springs 36, against the levers 9*a*–9*b* which resume their symmetrical position.

Figure 7:
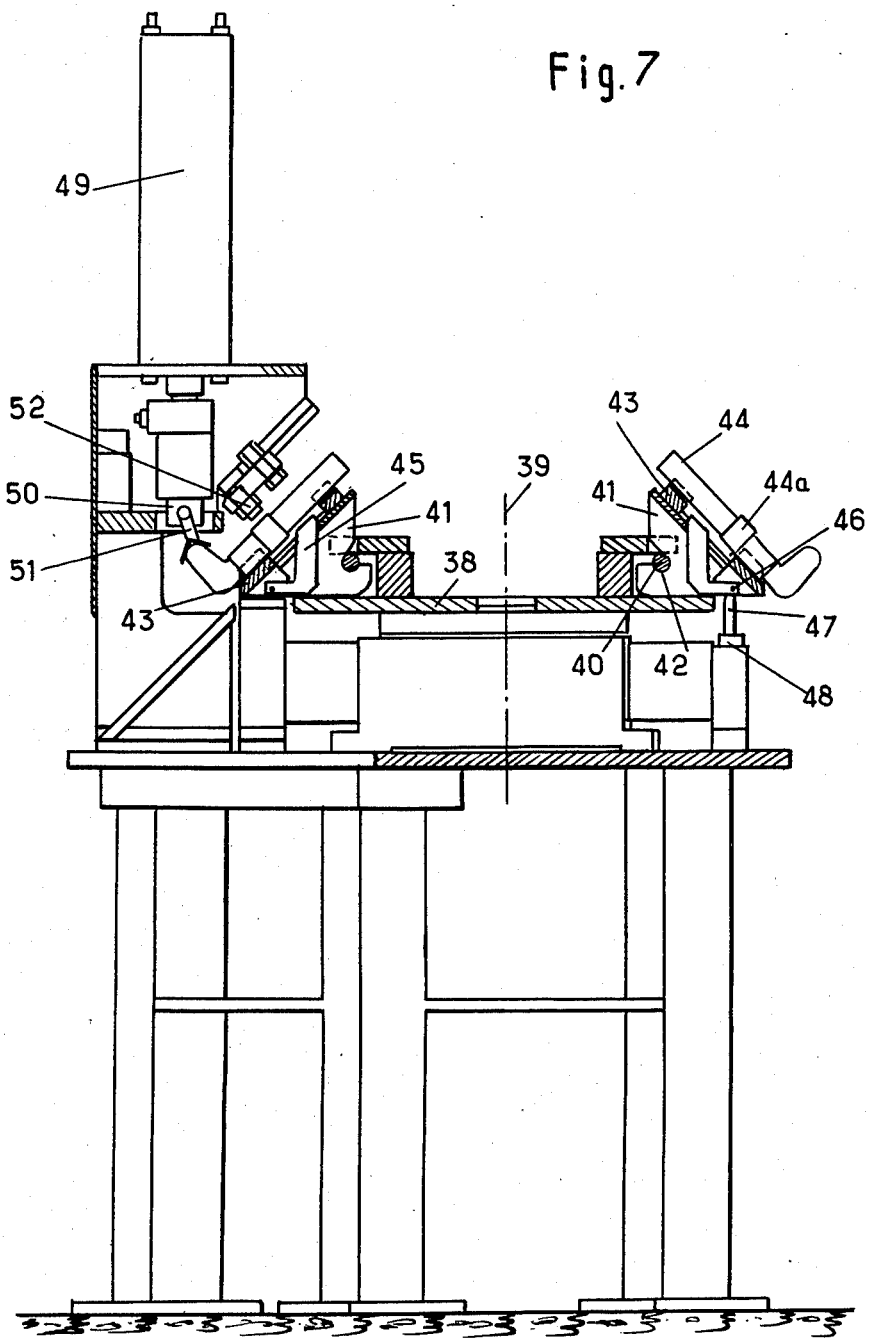
FIG. 7 is a cross-section of a fourth embodiment.

In the embodiment according to FIG. 7, the machine has a plate 38 rotatably mounted about a vertical axis 39 and which carries transversely-disposed bars 40. On each of these bars it is possible to fix a casting support 41 which is, for this purpose, provided with a notch 42 which engages the bar 40. The support 41 bears a cradle or bearings 43 adapted to receive a casting 44 from which the dead-heads have to be removed by holding it in an inclined orientation relative to the horizontal, the casting 44 being held, for example, by a shoulder 44*a*. An ejection lever 45 is pivotally mounted at 46 on the support 41 and is in contact with a pusher 47 fixed to the piston rod of a fluid-actuated cylinder 48.

As the plate 38 rotates, the casting supports 41 carried thereby pass successively past a loading station and several stations for the removal of dead-heads, one of which is shown at the left of FIG. 7.

Each dead-head removal station comprises a fixed fluid-actuated cylinder 49, the piston rod of which is rigid with a plate 50 acting as a support for a dead-head removal lever 51. A lever 52 is disposed in the vicinity of the cylinder to hold the casting during the removal of the dead-head so as to prevent if from swivelling under the effect of the force exerted upon it by the removal lever 51.

In operation, a casting is placed in a support 41 at the loading station. It then passes, in turn, past the various dead-head removal stations where at each of them, one or two dead-heads are removed by actuating the corresponding cylinder 49 in such a manner that the lever 51 exerts a bending stress on the dead-head while the casting is being held by the lever 52.

At the end of the cycle, pressurized fluid is supplied to the cylinder 48 in such a manner that the pusher 47 pivots the lever 45 which ejects the casting without its dead-heads 44 from its support 43.

Figure 8:
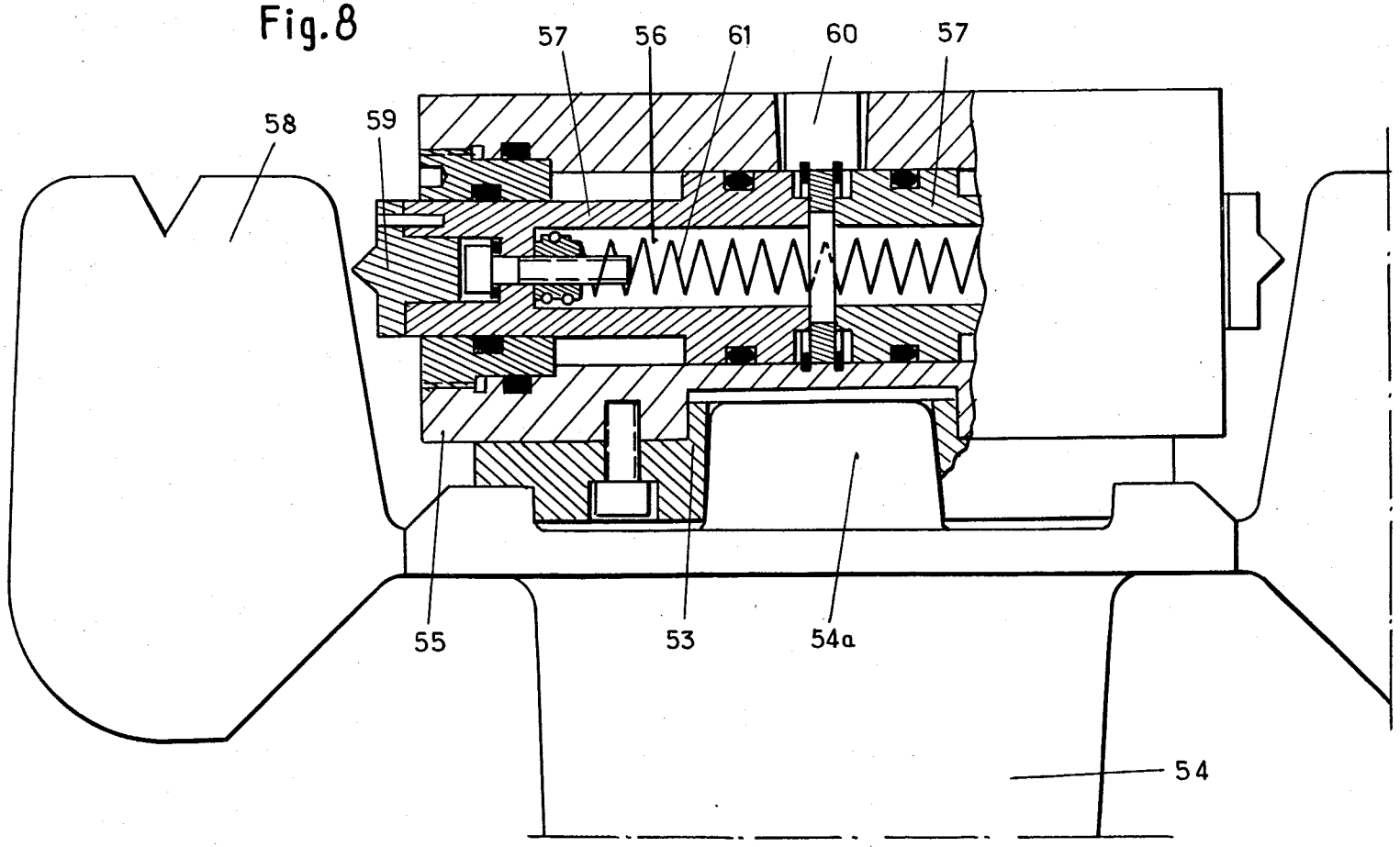
FIG. 8 is a cross-section of a fifth embodiment.

FIG. 8 shows a device which comprises a centering element 53 intended to be placed and fixed on the casting 54 whose dead-heads have to be removed, the element comprising a recess adapted to engage into a projecting portion 54*a* of the casting 54. Onto the element 53 there is fixed the body 55 of fluid-actuated means in which a chamber 56 is provided. The chamber 56 is shaped so as to receive two or more sliding pistons 57, each of which is mounted in front of a dead-head 58 to be removed the outer end of each piston carrying a breaking-off bit 59. In the example shown, the chamber 56 is cylindrical and contains two opposed pistons, with a fluid inflow and outflow port 60 opening out into the chamber 56, between the two pistons 57. The latter are joined together by a return spring 61.

When the chamber 56 is placed in communication with the source of fluid, the pistons 57 are removed apart and break off the dead-heads 58. The spring 61 then returns the pistons 57 to their initial position, when chamber 56 is drained.

The embodiments described are used to break off several dead-heads on the same casting. But they could also be used to separate an assembly of castings having a common dead-head. In this case, the machine would be supported on the common dead-head and would exert a bending moment on the castings to separate the castings from the dead-head.

In each of the embodiments described, the fluid-actuated cylinders and like components are preferably hydraulically operated.

The various forms of apparatus particularly described permit, by breaking the joining necks easy dead-head removal which can be used for most arrangements of castings and which do not generate excessive noise when in operation.

What is claimed is:

1. An apparatus for breaking a neck connecting a casting forming a first element to a dead-head forming a second element, comprising:

a support having a support axis and adapted to receive one of said elements for retaining same against twisting movement;

a pusher juxtaposed with said support and displaceable along said axis toward and away from said support; and at least one lever articulated to said pusher about a pivot axis perpendicular to said support axis, said lever having a free end engageable with the other of said elements to apply a force to said other element in a direction inclined to said neck, thereby generating a bending moment breaking said elements apart at said neck.

2. The apparatus defined in claim 1, further comprising a fluid-actuated cylinder and piston arrangement connected with said pusher for displacing same.

3. The apparatus defined in claim 2 wherein said free end of said lever has a concave shape engageable with a convex portion of said other element.

4. The apparatus defined in claim 2 wherein a pair of such levers having a common pivot axis and fitted together in mortise-and-tenon fashion are provided.

5. The apparatus defined in claim 4, further comprising spring means for retaining said levers in symmetrical positions relative to said axis.

6. The apparatus defined in claim 1 wherein said pusher is formed with a bridge member adapted to lie astride a central dead-head of the casting, wherein two such levers are pivotally mounted on said member and a cross piece interconnects the free ends of said lever.

7. The apparatus defined in claim 6 wherein said cross piece has a concave shape adapted to receive a convex portion of a lateral dead-head.

8. The apparatus defined in claim 1 wherein said pusher carries a plate and is movable to a frame supporting said pusher, at least one pair of such levers having a common pivot axis are provided on said plate, and each of said levers is engageable with a respective dead-head.

9. The apparatus defined in claim 8, further comprising locking means for retaining said plate in a position remote from said support whereby said plate and said levers are held in an inoperative position.

10. An apparatus for breaking a neck connecting a casting forming a first element to a dead-head forming a second element, comprising:

a support having a support axis and adapted to receive one of said elements for retaining same against twisting movement;

a pusher juxtaposed with said support and displaceable along said axis toward and away from said support;

at least one lever articulated to said pusher about a pivot axis perpendicular to said support axis, said lever having a free end engageable with the other of said elements to apply a force to said other element in a direction inclined to said neck, thereby generating a bending moment breaking said elements apart at said neck;

conveyor means movable along a predetermined path and provided with a number of such supports in spaced apart relationship, each of said supports being adapted to receive the said one element of a respective casting/dead-head unit;

means forming a dead-head removal station at a location along said path, said pusher and lever being mounted at said station; and a fluid actuated cylinder at said station for displacing said pusher.

11. The apparatus defined in claim 10 wherein said conveyor means comprises a rotating plate.

12. The apparatus defined in claim 10 wherein each of said supports is adapted to retain the respective one element of a casting/dead-head unit without being fixed thereto, said station being provided with holding means engageable with said one element of a casting/dead-head unit at said station to prevent swiveling thereof.

13. An apparatus for breaking a neck connecting a casting forming a first element to a dead-head forming a second element, comprising:

a support for removably receiving one of said elements and retaining said against twisting movement; and fluid operated force applying means juxtaposed with said support and including a pusher displaceable relative to said support and engageable with the other of said elements to apply a force thereto inclined to said neck to exert a bending moment upon said other element to break said elements apart at said neck, said fluid operated means being mountable on said one element and having at least two pistons simultaneously actuatable by fluid pressurization to apply a force in opposite direction to two such other elements of the casting/deadhead unit.

14. The apparatus defined in claim 13 wherein each piston acts directly upon the respective other element.

* * * * *